US007290354B2

(12) United States Patent
Perenich

(10) Patent No.: US 7,290,354 B2
(45) Date of Patent: Nov. 6, 2007

(54) SHOE SUSPENSION SYSTEM

(76) Inventor: Stephen Perenich, 4067 Briar Ct., Betterdorf, IA (US) 52722

( * ) Notice: Subject to any disclaimer, the term of this patent is extended or adjusted under 35 U.S.C. 154(b) by 182 days.

(21) Appl. No.: 10/826,693

(22) Filed: Apr. 19, 2004

(65) Prior Publication Data

US 2005/0005472 A1 Jan. 13, 2005

Related U.S. Application Data

(63) Continuation of application No. 10/717,915, filed on Nov. 21, 2003, now abandoned.

(60) Provisional application No. 60/491,260, filed on Jul. 31, 2003, provisional application No. 60/427,959, filed on Nov. 21, 2002.

(51) Int. Cl.
*A43B 13/28* (2006.01)
*A43B 13/14* (2006.01)

(52) U.S. Cl. ..... 36/27; 36/114; 36/102; 36/31; 36/7.8

(58) Field of Classification Search ..... 36/27, 36/31, 102, 103, 114, 38, 7.8, 28; 482/77–80; 601/27, 29
See application file for complete search history.

(56) References Cited

U.S. PATENT DOCUMENTS 1,613,538 A * 1/1927 Schad ..... 36/7.8
3,205,596 A * 9/1965 Hoffmeister ..... 36/7.8
3,557,782 A * 1/1971 Wafer ..... 482/75
4,936,030 A * 6/1990 Rennex ..... 36/28
5,282,325 A * 2/1994 Beyl ..... 36/27
5,464,380 A * 11/1995 Ikeda et al. ..... 601/29
5,621,984 A * 4/1997 Hsieh ..... 36/28
5,701,685 A * 12/1997 Pezza ..... 36/7.8
5,896,679 A * 4/1999 Baldwin ..... 36/27
5,926,975 A * 7/1999 Goodman et al. ..... 36/31
6,115,942 A * 9/2000 Paradis ..... 36/27
6,684,531 B2 * 2/2004 Rennex ..... 36/27

* cited by examiner

*Primary Examiner*—Jila M Mohandesi
(74) *Attorney, Agent, or Firm*—Larson & Larson; Frank Liebenon

(57) ABSTRACT

A shoe suspension system for use with a shoe or boot having an upper and lower sole. The system includes a first tandem hinge pivotally engaged between the upper toe sole and the lower toe sole which opens and closes parallel to the longitudinal axis of the shoe a plurality of tandem hinges pivotally engaged between the upper mid heel sole and the lower sole which also open and close parallel to the longitudinal axis of the shoe and return springs engaged between the upper mid heel sole and the lower sole.

5 Claims, 6 Drawing Sheets

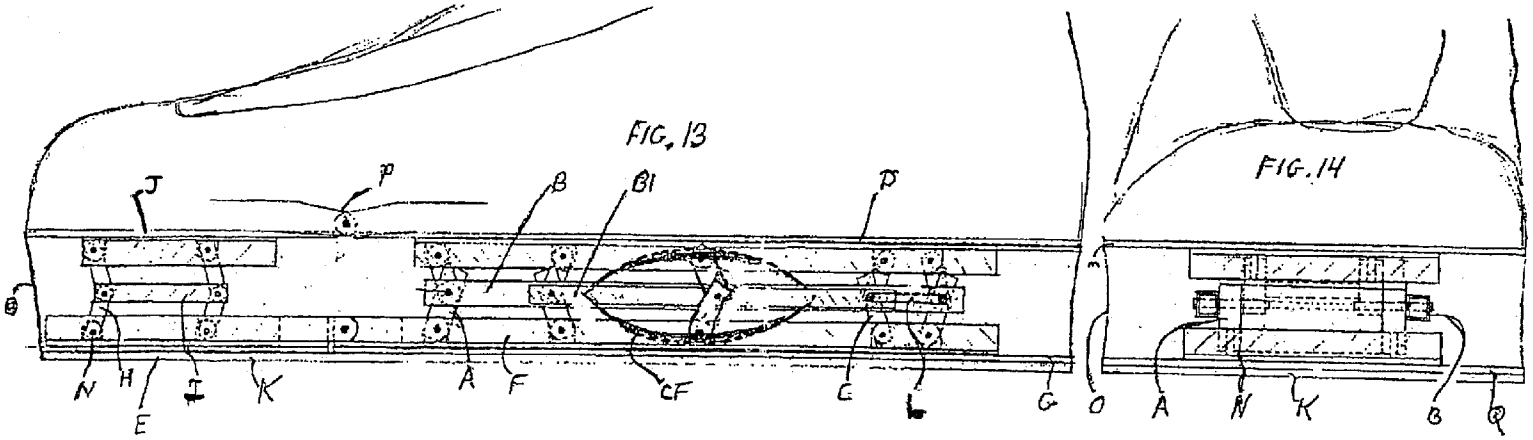
FIG. 13
FIG. 14
B1
B
CF
A
F
E
H
N
K
I
J
P
D
C
G
Q
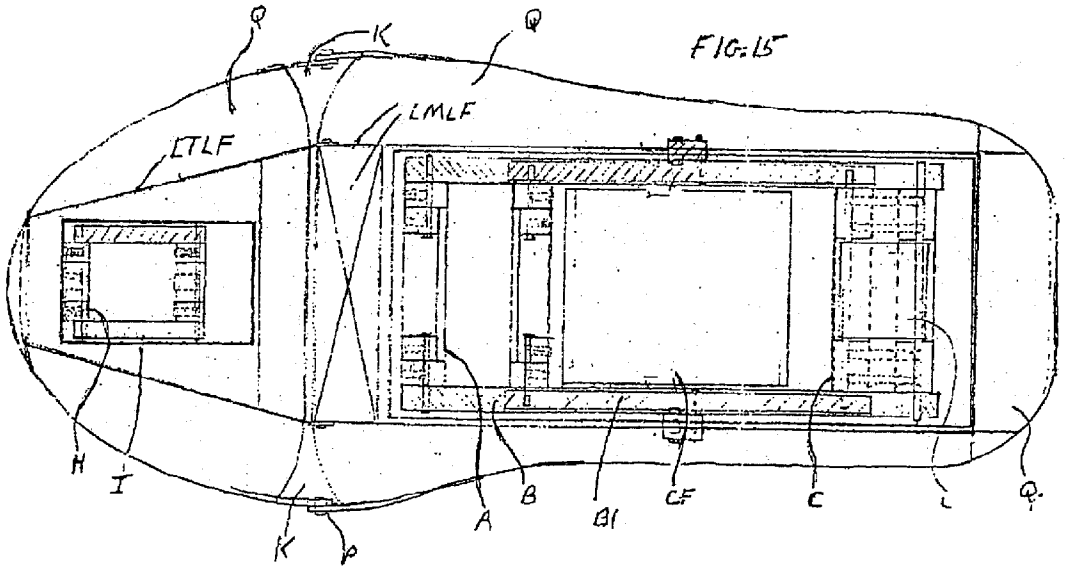
FIG. 15
Q
LMLF
LTLF
K
P
A
B
B1
CF
C
L
I
H
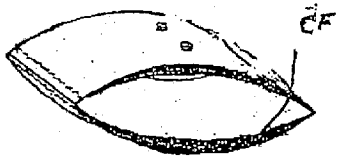
FIG. 16
CF
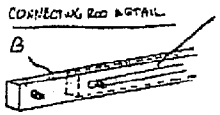
FIG. 12
B1
B

A1
B2
B3
CF
V
LMLF
LTLF
PINS
SB
P
J
O
H
I
E
K
R
B
D
F
L
C
G
B1
Q

SHOE SUSPENSION SYSTEM

CROSS-REFERENCE TO RELATED APPLICATIONS

This application is a continuation of non-provisional application no. 10/717,915 now abandoned, of prior U.S. provisional application nos. 60/427,959, filed Nov. 21, 2002, and 60/491,260, filed Jul. 31, 2003. The entire contents of all the above applications are hereby incorporated by reference.

BACKGROUND OF THE INVENTION

1. Technical Field

The present invention relates to the general art of boots and shoes, and to the particular field of impact absorbing and energy return mechanisms associated with boots and shoes.

2. Prior Art

It has long been known, that when people walk, jog, or run, a significant percentage of their forward kinetic energy is wasted and lost. This loss results in shock which is caused by a person's foot impacting with the ground. How to store and release this energy loss is the overall problem. Existing devices involve an assemblage of different types of springs adhered to the base of a shoe. Generally, the higher the assemblage elevates a user's foot above the ground, the more thrust imparted to the user. This fact leads to a problem with lateral stability. Generally, the higher a user's foot is elevated above the ground, the easier it will be for a user to twist an ankle. Coil springs are inherently unstable in a lateral direction causing unwanted sidesway, especially upon release. Devices that employ a group of coil springs arranged under a shoe generally lack adequate lateral stability and may pose a safety risk.

Some examples of different spring devices are found in:

U.S. Pat. No. 5,517,769

Spring-Loaded Snap-Type Shoe

The patent recognizes that a significant increase in performance requires a system to hold the energy loaded during heel-strike and release during step-off. The disclosed system used a ratchet to hold the loaded spring and triggers its release by bending the toe section of the shoe. Thus, this system attempts to time the release of energy during step-off.

(1) This system provides neither an optimum nor precise timing for energy release. The optimum timing of energy release occurs immediately following the decrease force during step-off. The system releases the loaded spring when the user bends at the ball of the foot which is not necessarily during and perhaps never at the optimum time.

(2) The system also returns energy to the heel alone. This is not ideal because the heel is not in contact with the ground during step-off.

(3) The system also requires a hollow cavity extending the length of the foot for the containment of the ratchet and spring system.

U.S. Pat. No. 4,936,030

Energy Efficient Running Shoe

This patent recognizes that an increase in performance requires a system to hold the energy loaded during heel-strike and release it from the ball or toe region during step-off. This system uses a ratchet to hold the loaded spring and triggers its release by bending the toe section of the shoe. The system also attempts to transfer the forces from the heel to the toe via a series of complex levers and shafts.

(1) This system provides neither an optimum nor precise timing for energy release. The optimum timing of energy release is immediately following ball peak-force during step-off. The system releases the loaded spring either: 1) when said spring reaches a certain and fixed degree of compression, 2) when said spring reaches the limit of compression during push-off, or 3) after a fixed time delay. Although the patent neither explains not diagrams the process by which it accomplishes (2) or (3), these methods are inadequate and not optimal. The first and third processes are based on fixed criteria and cannot adapt to the variable forces and time periods during normal running. The second process is inadequate because it releases the spring prematurely. A user, during a turn or stop may load the forces on his forefoot at constant level before he has picked his final direction. This process therefore, can cause the user to lose control.

(2) The system does not guarantee nor does it disclose that the ball and heel will compress in a parallel manner. This is because of the number of parts, the complexity of design and the looseness of the system.

U.S. Pat. No. 6,029,374

Shoe and Foot Prosthesis with Bending Beam Spring Structures This structure attempts to address the simplicity and efficiency of carbon fiber bending beam springs. This structure also attempts to address the need for both heel and toe springs that prevent lateral movement. This structure is inadequate for some of the following reasons: 1) It does not provide a strictly parallel postured upper and lower sole and thus it cannot return more than half the user's weight, 2) it does not provide a parallel upper and lower toe sole and therefore depends on a tapered leaf spring for traction and control which does not provide either in an optimum way, 3) it does not provide a hold and release system (HRS) that limits the combined load forces of the springs to approximately the user's weight.

Patent Number WO 01/05469A1 (German and International Patent)

Device for Helping a Person to Walk

1) It does not provide a strictly parallel postured upper and lower sole of normal length nor does it provide a parallel upper and lower sole toe and therefore does not provide adequate balance and control, 2) it does not provide a longitudinally pivoting lower sole and therefore does not allow for adequate agility, 3) it does not address HRS and therefore limits the efficiency of the springs, and 4) each boot weighs approximately 20 pounds which dramatically slows the foot-speed of the user and therefore overall running speed.

OBJECT AND SUMMARY OF THE INVENTION

Spring shoes thus far have not been entirely satisfactory in that they have not permitted users to concurrently experience: 1) traction, control, agility and safety comparable to non-spring-loaded footwear, 2) comparable impact absorption and 3) true energy conservation (i.e. storage and return) during walking and running. Spring shoes that have attempted to address the energy conservation issued have employed either very complex, expensive and unreliable structures or ineffective and imprecise structures. No non-fuel-propelled footwear devices has thus far allowed users to increase their maximum running speed. While some have allowed an increase in stride-length, their unnatural use and/or excessive weight prevent users from running any faster than with standard running shoes.

It is the object of the present invention to overcome the problems inherent to the prior art devices.

This is achieved by:

(1) Providing an upper and lower sole which are parallel to each other wherein the lower sole moves away from the upper sole in a substantially perpendicular direction. This permits optimum control, safety, and agility, energy transfer from the heel to the ball of the foot, and natural walking and running motion.

(2) Forming the lower sole to correspond to the anatomy of the foot and ankle of the user to allow optimum traction stability, control and safety. Wherein the lower sole can include a rigid inner mid-sole and a flexible outer mid and heel sole to provide mild internal roll capability.

(3) Providing structure that maintains a longitudinally parallel posture between the upper and lower toe-sole during mid-stride compression, forward roll and toe-sole lift off, thereby allowing users optimum balance, control, traction and safety.

(4) Limiting the maximum and minimum opening of the soles while at the same time, softening the impact of the foot as the sole reaches its full compression, thereby increasing control, stability, safety and comfort.

(5) Providing in embodiments in which the compressed spring load significantly exceeds a user's body weight, a system to hold and release ("HRS") the energy stored in the springs at an optimum time during accelerating, cruising or while decelerating. Utilizing this system, the performance benefit is roughly proportionate to the stored energy loads in excess of the user's body weight. Thus, this structure allows users to more than double their running stride and jumping performance compared to similar models without this system. This system is optimally designed in that it delivers: 1) Excellent control, 2) high running and jumping performance, 3) safe deceleration/stopping, 4) a greater measure of running efficiency, allowing users to run longer distances while burning the same calories, 5) a completely natural running motion, which in turn, further increases stability, reduces fatigue, and further increases performance, and 6) a safety default to disengage the system if mechanical failure occurs.

The components necessary to enable this system are: pressure sensor, microprocessor, relay, battery pack, solenoid, lever, ratchet wheel, winding cable, wire and coil spring. As a user runs, the shoe's sole is compressed. During this process, the winding cable is gathered and wound by the ratchet wheel. At the same time, the pressure sensors send signals to the microprocessor via wire, which determines the timing of holding and releasing the stored energy. At the appropriate times, it sends a signal via wire to the relay. The relay then activates, via wire, the solenoid which is powered, also via wire, by the battery pack. The solenoid then first pulls the arm and lever, thereby stopping the ratchet wheel from rotating and holding the compression of the sole. Then subsequently, the solenoid releases the arm and lever which is pulled back by the coil spring, thereby liberating the ratchet wheel to rotate. This in turn releases the winding cable and allows expansion of the sole.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 13 is a side and cross-sectional view of the fifth embodiment constructed in accordance with the principles of the present invention.

FIG. 14 is a front and cross-sectional view of the fifth embodiment according to FIG. 13.

FIG. 15 is a top view of the lower sole including the spring system between the upper and lower soles of the fifth embodiment according to FIG. 13.

FIG. 16 is a perspective view of the leaf spring of FIG. 13.

FIG. 22 is a perspective view of the connecting rods.

List of Structural Elements Included in Embodiments 1-6

A) Primary Tandem Hinges/Links (A)
A1) Lateral Tandem Links
B) Primary Connecting Rods
B1) Lateral Connecting Rods
B2) Primary Opposing Connecting Rods B3) Lateral Opposing Connecting Rods
C) Primary Opposing Tandem Hinges/Links
C1) Lateral Opposing Links
D) Upper Mid/Heel-sole
E) Lower Toe-sole
F) Lower Mid-sole
G) Lower Heel-sole
H) Secondary Tandem Hinge
I) Secondary Connecting Rod
J) Upper Toe-sole
K) Tread
L) Stopper
M) Cable
N) Pivot
O) Screen
P) Flex Point
Q) Lower Sole Flexible Section
R) Rivet
S) Torsion Spring (S)
T) Lateral Support Bumper
U) Heel Torsion Spring (S)
V) Tension Spring/Rubber Band
W) Independent Torsion Spring Hinge/Diamond Link (W)
X) Hinge Pin
AR) Arm
AS) Ankle Support
BJ) Ball Joint
BP) Battery Pack (BP)
BR) Bumper (BR)
CF) Opposing Leaf Springs (CF)
CS) Coil Spring (CS)
IV) Inlet Valve (IV)
LV) Lever (LV)
MP) Microprocessor (MP)
OO) Side Wall (OO)
OV) Outlet Valve (OV)
PS) Pressure Sensor (PS)
RL) Relay (RL)
RW) Ratchet Wheel (RW)
SN) Solenoid (SN)
WC) Winding Cable (WC)
WR) Wire (WR)
CT) Coupling Tube
SB) Steel Band
LTLF) Lower Toe Ladder Frame
LMLF) Lower Mid Ladder Frame

DETAILED DESCRIPTION OF THE PREFERRED EMBODIMENTS OF THE INVENTION

The spring shoe inventions here proposed relate to six different Embodiments that have specialized applications.

Figure 2:
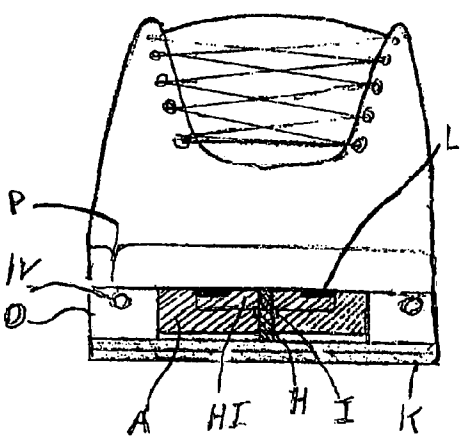
FIG. 2 is a front and cross-sectional view of the first embodiment according to FIG. 1.
Figure 3:
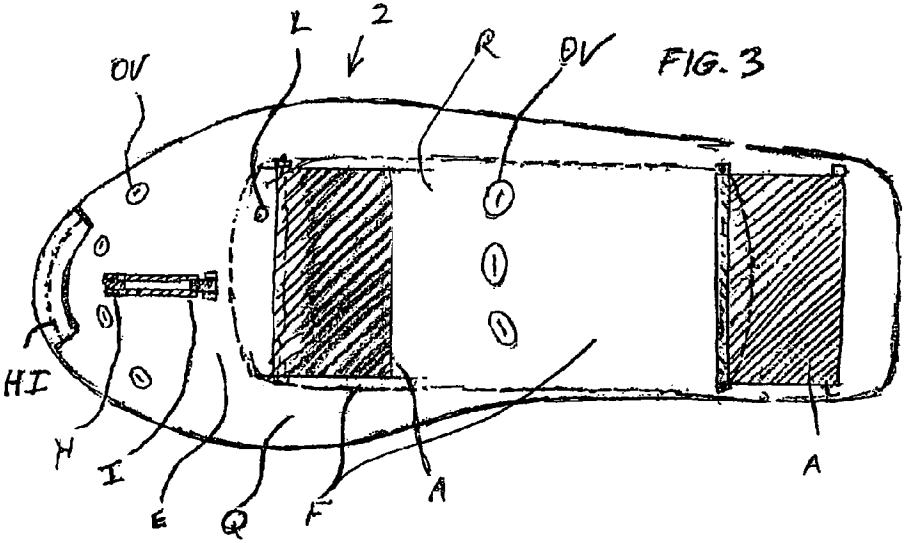
FIG. 3 is a top view of the lower sole of the first embodiment according to FIG. 1.
Figure 1:
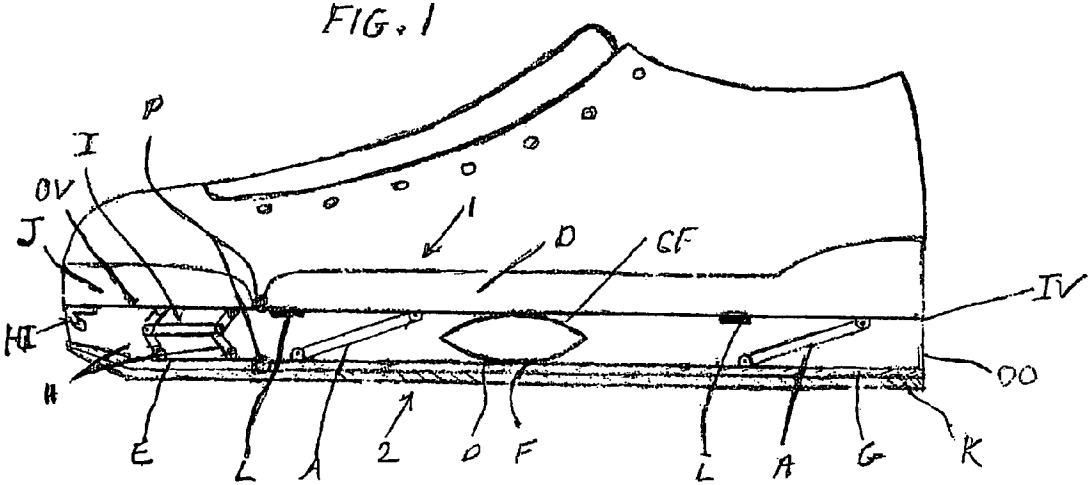
FIG. 1 is a side and cross-sectional view of a first embodiment constructed in accordance with the principles of the presented invention. In this view, no weight has been placed on the soles.

Embodiment 1 is a low cost walking/running shoe. The first embodiment of FIGS. 1-3 shows upper sole (1) of a shoe parallel to lower sole (2). The lower mid sole (F) of embodiment 1 is integrated with the lower heel-sole (G) and consists of an inflexible section (e.g. steel, reinforced carbon fiber, or hard plastic) with a lower sole flexible section (Q) (e.g. fiberglass) extending laterally from the inflexible section, and filling out the foot-profile-shaped lower sole. This structure is hinged to the trailing edge of the lower toe-sole (E). The inflexible section is in the same plane as the lower sole flexible section (Q).

The lower sole (2) is formed to cooperate with the anatomy of the foot and ankle allowing users optimum traction, stability, control and safety. The lower sole (2) has a tread (K) engaged to its bottom side and comprises rigid inner section (F) and a flexible outer section (Q) in the same plane as that of the rigid inner section (F), to provide mild lateral and longitudinal roll capability.

Secondary tandem hinge (H) and links (A) are hinged between the upper sole (1) and the lower sole (2). The lower toe-sole (E) and the upper toe sole (J) are engaged together by secondary tandem hinge (H). The purpose of this structure is to: 1) provide traction to the user during step-off, 2) enhance balance and stability during step-off, 3) allow normal use and movement of the toe for greater comfort and, 4) to keep the stride movements natural both during longitudinal and lateral directions. Secondary tandem hinge (H) serves the same purpose in embodiments 2-6.

Secondary tandem hinge (H) contains two parallel hinges which are engaged to the upper and lower toe soles (J) and (E). These hinges are engaged to each other by a pair of secondary connecting rods (I). These hinges should be constructed of an inflexible material (e.g. steel). The purpose of this structure is to: 1) Allow for extension of the lower toe-sole (E) in a direction perpendicular from the upper toe-sole (J), 2) provide two congruent lever (LV) arms and therefore congruent swing angles and 3) provide attachment points for the secondary connecting Rod (I)s.

Secondary connecting rods (I) are attached to the sides of the secondary tandem hinges (H). The length of these parts coincides with the distance between the anchoring points of the secondary tandem hinges (H) to the upper and lower toe-soles (J) and (E) allowing the secondary tandem hinges (H) to move in a parallel motion as the upper and lower toe-soles (J) and (E) close together. This structure must be made of a rigid material (e.g. steel or alloy) so as to resist compression, expansion or failure. The purpose of this structure is to maintain equal distance between the tandem hinges, thereby ensuring that the upper and lower toe-sole (E) remain parallel throughout compression and expansion, thus allowing users optimum balance, control, traction and safety.

Opposing leaf springs (CF) are formed from carbon fibers and are fixed between the upper sole (1) and the lower sole (2). Optionally, a carbon fiber toe spring (HI) can be positioned at the front end of the upper toe sole. Stops (L) are fixed to the lower side of the upper mid/heel portion (D) to absorb the impact of the links (A) and maintain the parallel position of the upper and lower soles when the hinges are compressed between the upper and lower soles. Screen (O) forming a side wall OO, extends from the periphery of the upper and lower soles.

The structure located between the upper sole (1) and the lower sole (2) assures that when the lower sole (2) moves away from the upper sole (1) it is in a substantially perpendicular direction. This results in 1) optimum control, safety, and agility, for the user 2) energy transfer from the heel to the ball of the foot, and 3) natural walking and running motion.

The lower sole (2) of embodiment 1 is patterned after the anatomy of the foot and ankle allowing users optimum traction, stability, control and safety. The lower sole provides for an integrated lower toe sole portion (E), lower mid sole portion (F), flexible outer portion (Q) of the mid sole (F) and lower heel sole (G) provides mild lateral roll capability.

Figure 5:
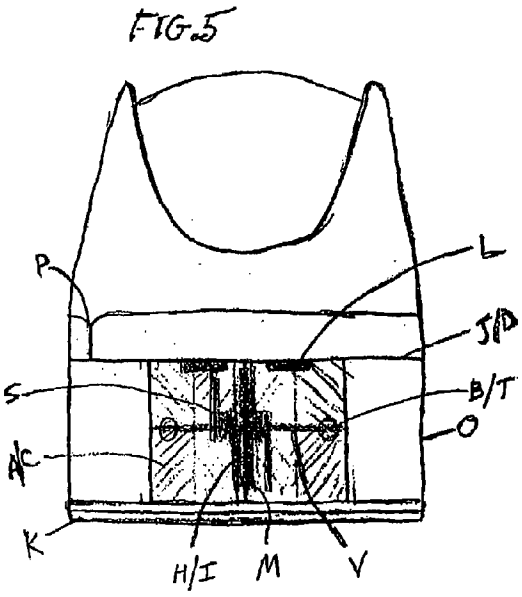
FIG. 5 is a front and cross-sectional view of the second embodiment according to FIG. 4.
Figure 6:
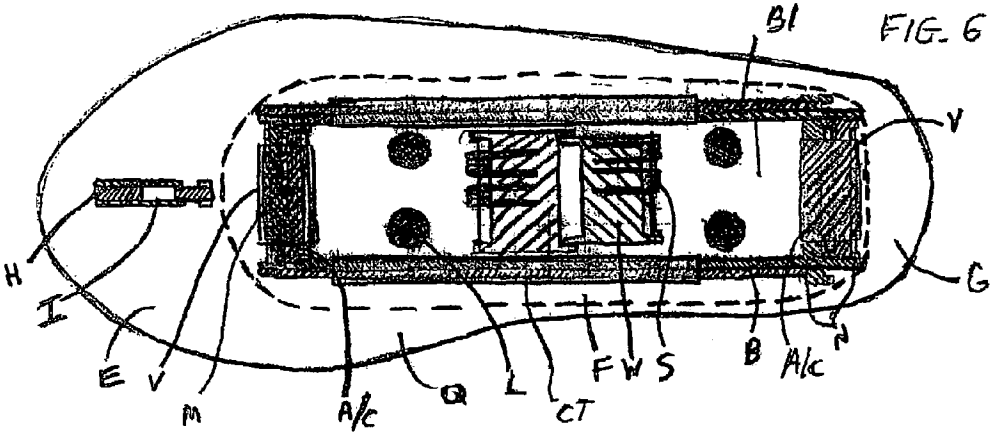
FIG. 6 is a top view of the lower sole including the spring system between the upper and lower soles of the second embodiment according to FIG. 4.
Figure 4:
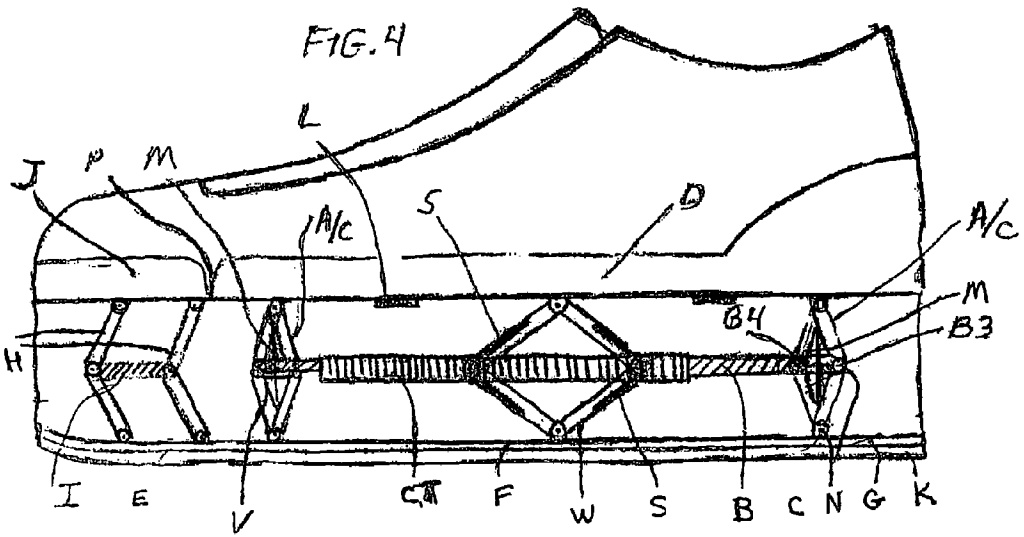
FIG. 4 is a side and cross-sectional view of a second embodiment constructed in accordance with the principles of the present invention. In this view, no weight has been placed on the soles.

Embodiment 2 is a high performance running shoe for straight line running. Embodiment 2 as shown in FIGS. 4-6, also includes, as in embodiment 1, an upper sole (1), a lower sole (2), upper toe sole portion (J), upper mid heel sole portion (D), tread (K), a lower rigid inner section (F), a lower flexible outer section (Q), and a secondary tandem hinge (H) engaged between the lower sole (2) and the upper toe sole portion (J), and stops (L). The upper sole (1) includes a flex point (P) connecting an upper toe sole portion (J) to the upper mid/heel portion (D). These elements serve substantially the same purpose as the equivalent elements of the first embodiment. However, the links (A) and opposing leaf springs (CF) of the first embodiment are replaced by a system of interconnected hinges and linkages that provide a true perpendicular movement, over a greater distance between the upper and lower soles, than that of the first embodiment. Furthermore, this system allows a greater percentage of the distance between the soles to be compressed. The sole design of embodiment 2 is the same as that of embodiment 1.

The system of interconnected hinges and linkages includes a pair of diamond links (A/C) hinged on pivots (N) between the upper sole (1) and lower sole (2) at opposite ends of upper mid/heel sole portion (D), a diamond link (W), biased by springs (S) hinged between the upper sole (1) and lower sole (2). An outer connecting rod (B1) and inner connecting rod (B2) are slidably engaged and located laterally on the sides of diamond links (A/C). Opposite ends of the outer connecting rod (B1) are pivotally engaged to each pivot point (B3) of each of the diamond links (A/C) and the ends of the inner connecting rod (B2) are pivotally engaged to each pivot point (B4) of each of the diamond links (A/C). Each pair of outer connecting rod (B1) and inner connecting rod (B2) extend through coupling tube (CT), which maintains the rods in slidable engagement. As shown in FIG. 5, the shape of diamond links (A/C) preclude rotation of the lower sole around the longitudinal axis of the shoe.

Primary connecting rods (B) and primary opposing connecting rods (B2) must be made of light and rigid material so as to resist compression, expansion, deflection or failure (e.g. steel or alloy). Primary connecting rods (B) connect the two primary tandem hinges/links (A) while the primary opposing connecting rods (B2) connect the primary opposing tandem hinges/links (C). The rods are always engaged together so that they remain slidably connected to one another. This is accomplished through the use of the coupling tube (CT). The purpose of the rods is to: 1) maintain equal distance between the tandem hinges/links (A) and (C) thereby ensuring that the upper and lower mid-sole (F) remain longitudinally parallel to one another throughout compression of the soles, 2) prevent the upper mid/heel-sole (D) from moving forward or backward relative to the lower mid-sole (F) and 3) couple the tandem hinges/links (A) and (C), thereby providing additional resistance to twisting forces on either primary tandem hinges/links (A) or primary opposing tandem hinges/links (C). A friction reducing liquid (e.g. oil, grease Teflon) may be added to insure smooth operation of the rods.

In both the embodiments 1 and 2, the lower toe-sole (E) is an extension of the lower mid-sole (F). This structure should be flexible and strong (e.g. fiberglass and/or carbon fiber) and somewhat resistant to bending forces (but flexible is enough to allow natural roll of the foot during stride.) The structure and function of rubber band (V) which acts as a return spring and cable (M) which limits the distance that the lower sole can move away from the upper sole are discussed below in greater detail.

Figure 8:
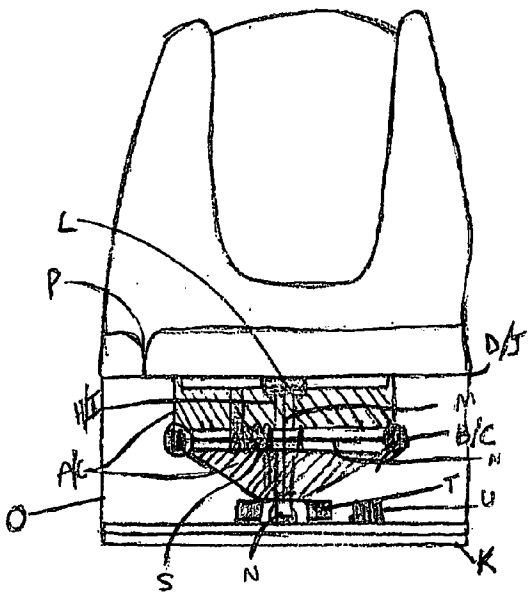
FIG. 8 is a front and cross-sectional view of the third embodiment according to FIG. 7.
Figure 9:
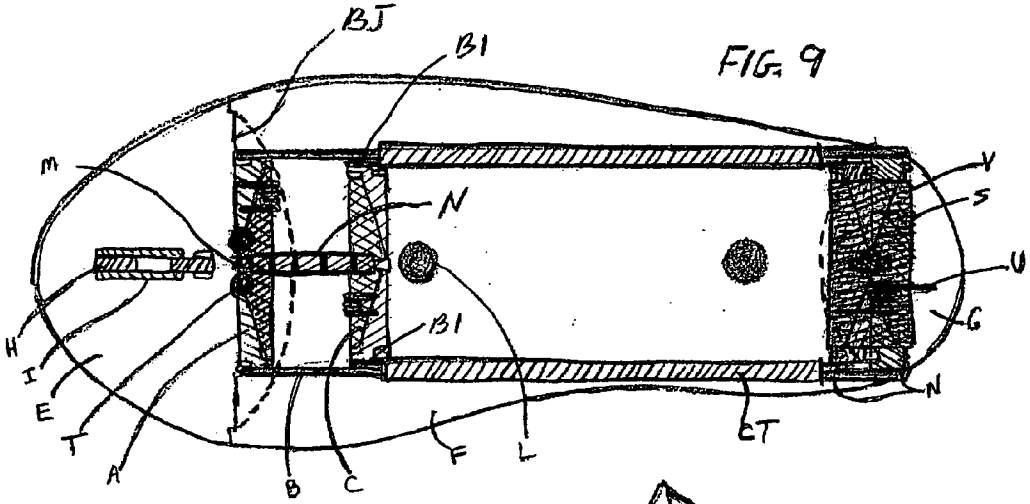
FIG. 9 is a top view of the lower including the spring system between the upper and lower soles of the second embodiment according to FIG. 7.
Figure 7:
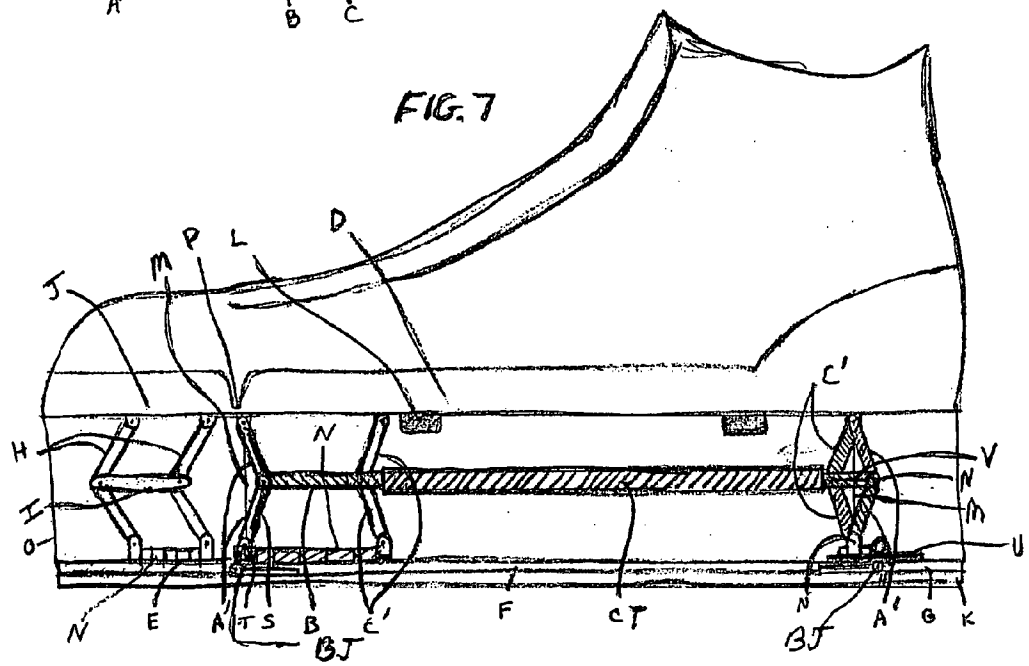
FIG. 7 is a side and cross-sectional view of a third embodiment constructed in accordance with the principles of the present invention. In this view, no weight has been placed on the soles.
Figure 11:
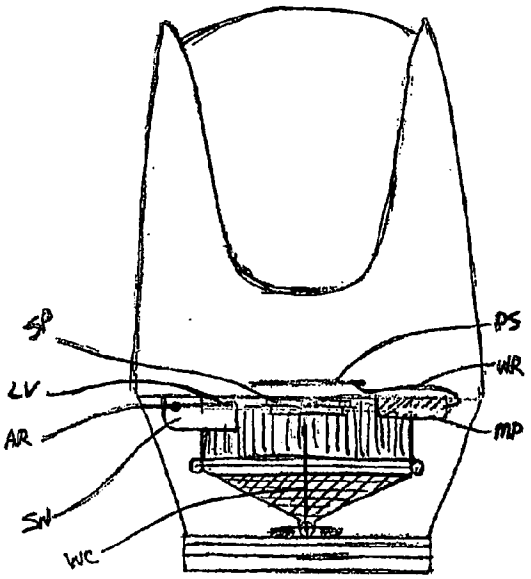
FIG. 11 is a front and cross-sectional view of the fourth embodiment according to FIG. 10.
Figure 10:
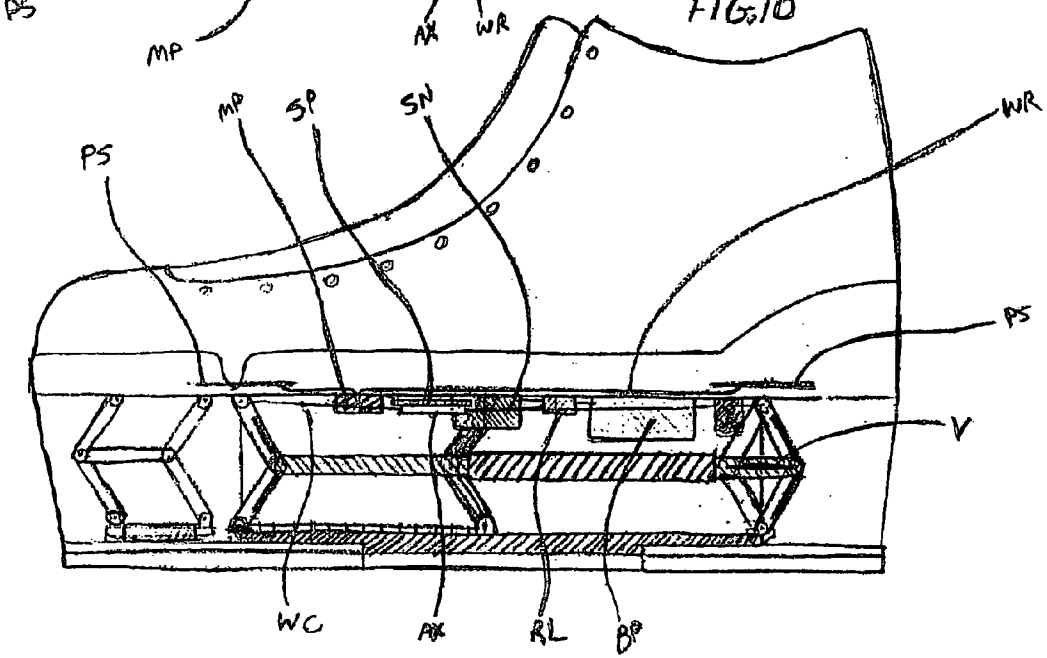
FIG. 10 is a side and cross-sectional view of the fourth embodiment constructed in accordance with the principles of the present invention. In this view, no weight has been placed on the soles.
Figure 12:
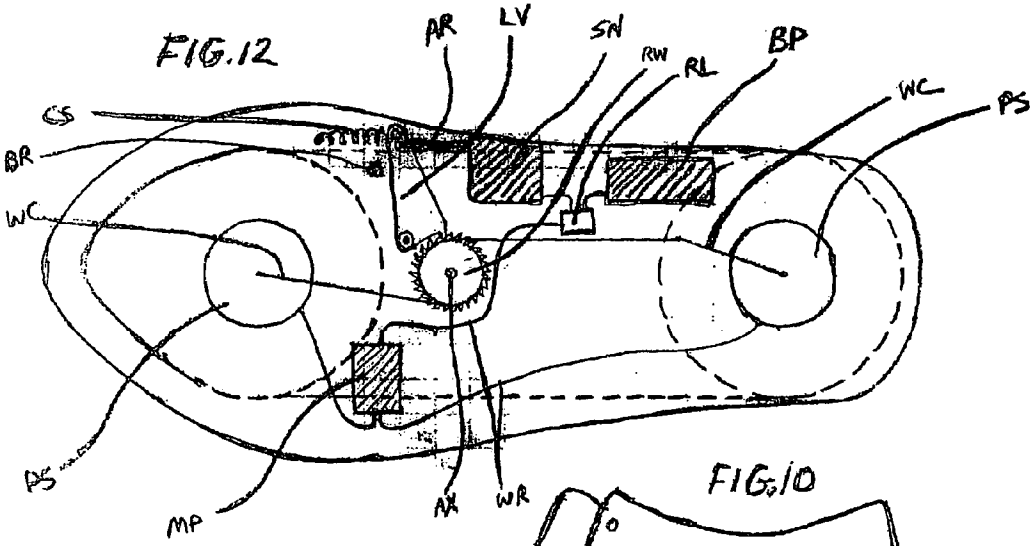
FIG. 12 is a top view of the lower sole including the spring system between the upper and lower soles of the fourth embodiment according to FIG. 10.
Figures 17, 18, 19, 20, 21:
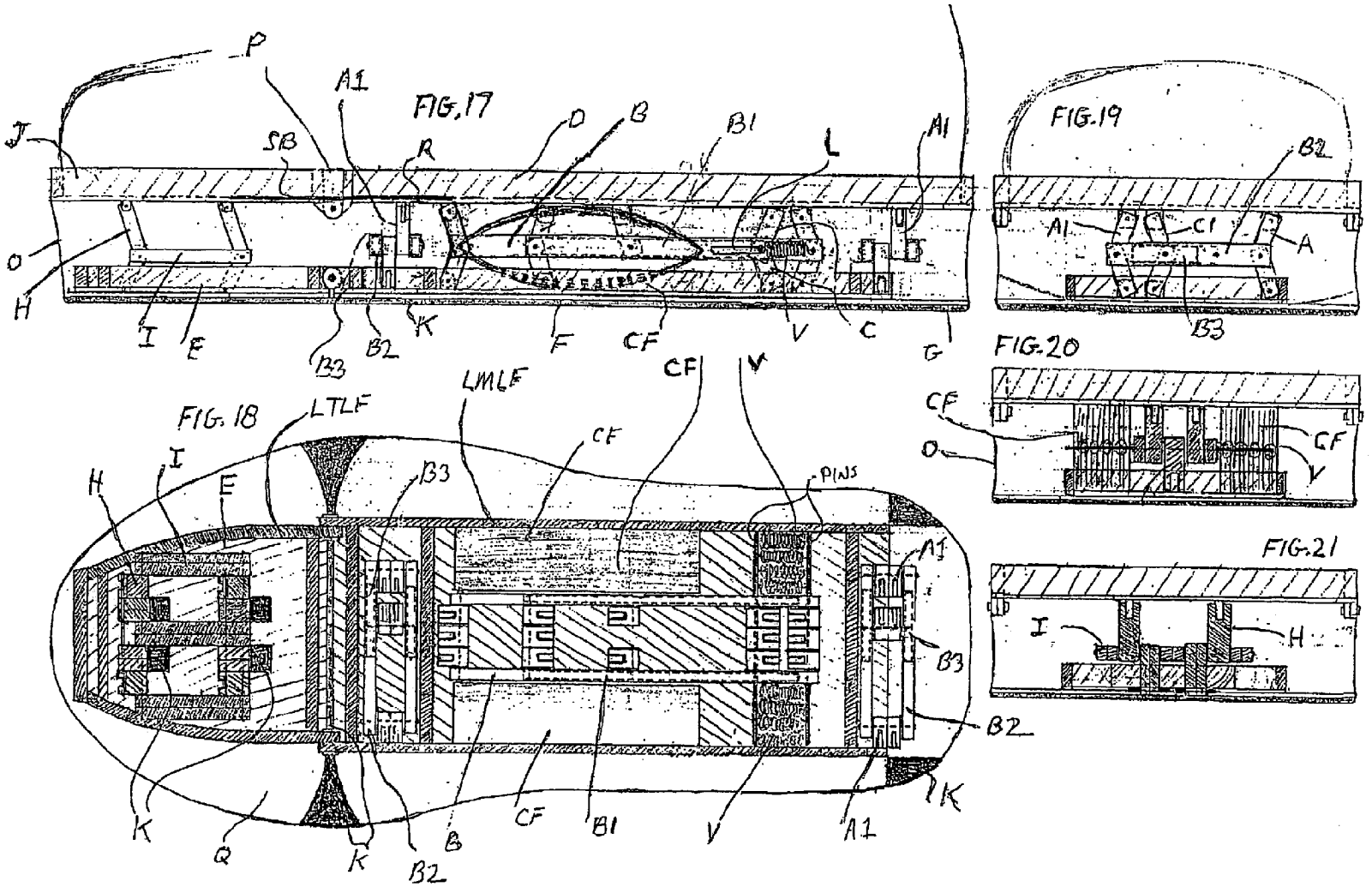
FIG. 17 is a side view and cross-sectional view of the sixth embodiment constructed in accordance with the principles of the present invention. In this view, no weight has been placed on the soles.
FIG. 18 is a top view of the lower sole including the spring system between the upper and lower soles of the sixth embodiment according to FIG. 17.
FIG. 19 is a front view and cross-sectional view of the sixth embodiment in accordance to FIG. 17
FIG. 20 is a cross-sectional view of the sixth embodiment through Section A-A of FIG. 17.
FIG. 21 is a rear view and cross-sectional view of the sixth embodiment in accordance to FIG. 17.

Embodiment 3 is a high performance cross trainer. Embodiment 3 of FIGS. 7-9 also include an upper sole (1), a lower sole (2), an upper toe sole portion (J), upper mid sole portion heel portion (D), tread (K), and the secondary tandem hinge (H) engaged between the lower sole (2) and the upper toe sole portion (J) and stops (L). In embodiment 3, a lower toe sole (E) consists of a circular pad that is hinged to the forward edge of the lower mid sole (F). This structure is also provided in embodiment 4. The upper sole (1) includes hinges connecting the upper toe sole (J) to the upper mid sole portion (D). These elements serve substantially the same purpose as the equivalent elements of the first and second embodiments. Embodiments 4, 5 and 6 also have in common the above-identified elements. The lower sole design of embodiment 3 provides a distinct lower toe sole portion (E), rotatably engaged to a lower mid sole portion (F) and a lower heel sole portion (G), also rotatably engaged to mid sole portion by a hinge or ball point (BJ). Embodiment 3 also provides a system of hinges located between the upper toe/mid/heel-soles (J) and (D) and lower toe/mid/heel soles (E), (F) and (G) that allow lateral pivot of the upper toe/mid/heel-soles (J) and (D) relative to the lower toe/mid/heel soles (E), (F) and (G) allowing users a high degree of agility in a relatively long shoe suspension travel design.

In embodiment 3, the lower mid-sole (F) consists of an inflexible (e.g. steel), rectangular plate. The lower sole is connected to the tandem hinges by longitudinal pivots that allow lateral pivoting of the lower sole. A lateral support bumper (T) is inserted between the lower mid-sole (F) and the tandem hinge arm's hinge pin (X). An alternative structure can be used comprising of an inflexible rod connected at the ends to lower toe and heel soles via front and rear ball joints. This alternate structure also specifies a coil spring (CS) above the ball joint. The purpose of these structures is to: 1) provide traction to the user during mid-stride and 2) enhance balance and stability during mid-stride in a straight-line or in a turn.

All the primary and secondary tandem and opposing tandem hinges' (A), (A/C) and (H) have lower plates that are triangular in shape with their apex positioned at the lower toe/mid/heel soles (E), (F) and (G) where the apex attaches to the topside of lower toe/mid/heel soles (E), (F) and (G) by way of longitudinal pivots (N). As noted above, part of this system including a lateral support bumper (T) inserted between the lower mid-sole (F) and the primary tandem hinge (A) lower hinge pin (X). The lateral support bumper (T) is cylindrical in shape and constructed of an elastic and resilient material.

The lateral support bumper (T) is provided in both embodiments 3 and 4, and is placed between the lower mid-sole (F) and the primary tandem hinges/links (A) hinge pin. It is constructed of a resilient material (e.g. rubber). The purpose of this part is to: 1) resist lateral pivoting of the upper soles, thereby increasing stability and reducing injury, and 2) provide resistance for the lower heel-sole (G) to flex, keeping it in-line with the lower mid-sole (F) when not stressed, thereby increasing the user's balance and allowing for smooth operation of the shoe during heel-strike.

The ball joint (BJ) with integral coil spring (CS) is an option in embodiment 3 and 4. The structure is defined by a raised circular plateau in the center of the lower toe and heel sole. A ball joint (BJ) is positioned in the center of this plateau. Extending down in a perpendicular direction from the lower mid-sole (F) rod is an arm with a ball on the end. Located at the top of the arm is a fixed collar, positioned parallel to the lower mid-sole (F) rod. A coil spring (CS) is placed between the collar and the lower toe/heel sole. The purpose of this structure is to: 1) allow the lower toe and heel soles to pivot 360 degrees, thus increasing lateral movement and overall agility, 2) Provide pivoting resistance to the lower toe and heel soles, thereby increasing stability and safety, 3) Simplify and lighten the shoes compared with other structures.

Embodiment 4 is an ultra-high performance cross trainer. Embodiment 4 also provides the same primary and secondary tandem and opposing tandem hinges (A), (C), (A/C) and (H) of embodiment 3 wherein the lower plates are triangular in shape as in embodiment 3 where they attach to the top side of lower toe/mid/heel soles (E), (F) and (G) in the same manner as in embodiment 3.

In embodiments 3 and 4, the lower mid-sole (F) is distinct from the lower heel-sole (F), is hinged to its leading edge and hinged to the trailing edge of the lower toe-sole (E) and should be constructed of an inflexible material. Attached to the topside trailing edge of the lower mid-sole (F) is a heel torsion spring (S). For all embodiments, tandem hinges (A) and (C) are engaged to the topside of the lower mid-sole (F)

For Embodiments 3 and 4, the lower heel-sole (G) consists of a circular pad that is hinged from its center, to the aft-edge of the lower mid-sole (F), heel torsion spring (S) and tread (K). This structure should be inflexible and strong (e.g. steel or alloy). The heel torsion spring (S) is a spring constructed of spring steel. This structure is attached to the topside of the lower mid-sole (F) and the lower heel-sole (G) where they meet. The purpose of this structure is to efficiently absorb energy during heel strike while at the same time allowing for maximum traction.

In the high performance application of embodiment 4, the compressed spring load significantly exceeds a user's body weight. This system holds and releases ("HRS") the energy stored in the springs at an optimum interval during accelerating, cruising or while decelerating. Utilizing this system, the performance benefit is roughly proportionate to the stored energy loads in excess of the user's body weight. Thus, this structure allows users to more than double their running stride and jumping performance compared to similar Embodiments without this system. This system is optimally designed in that it delivers: 1) Excellent control, 2) High running and jumping performance, 3) Safe deceleration/stopping, 4) A greater measure of running efficiency, allowing users to run longer distances while burning the same calories, 5) A completely natural running motion, which in-turn, further increases stability, reduces fatigue, and further increases performance and 6) A safety default to disengage system if mechanical failure occurs.

The components necessary to enable embodiment 4 are: pressure sensor (PS), microprocessor (MP), relay (RL), battery pack (BP), solenoid (SN), lever (LV), ratchet wheel (RW), winding cable (WC), wire (WR) and coil spring (CS). As a user runs, the shoe's sole is compressed. During this process, the winding cable (WC) is gathered and wound by the ratchet wheel (RW). At the same time, the pressure sensor (PS)s send signals to the microprocessor (MP) via wire (WR), which determines the timing of holding and releasing the stored energy. At the appropriate times, it sends a signal via wire (WR), to the relay (RL). The relay (RL) then activates, via wire (WR), the solenoid (SN) which is powered, also via wire (WR), by the battery pack (BP). The solenoid (SN) then first pulls the arm and lever (LV), thereby stopping the ratchet wheel (RW) from rotating and holding the compression of the sole. Then subsequently, the solenoid (SN) releases the arm and lever (LV) which is pulled back by the coil spring (CS), thereby liberating the ratchet wheel (RW) to rotate. This in turn, releases the winding cable (WC) and allows expansion of the sole.

The pressure sensor (PS) is approximately 1 inch in diameter and relatively thin. It is positioned in the center topside of the ball and heel pad within the shoe upper. It has a wire (WR) attached to it sending the electronic signal to the microprocessor (MP). The purpose of this structure is to measure the loads that the user imparts on the ball and heels of his or her feet.

The wire (WR) structure is approximately six inches long and relatively thin. It is made of copper and coated with rubber or plastic. It attaches the pressure sensor (PS)s to the microprocessor (MP), the microprocessor (MP) to the relay (RL), the battery pack (BP) to the relay (RL) and the relay (RL) to the solenoid (SN). The purpose of this structure is to relay (RL) electronic signals between these components.

The microprocessor (MP) structure is relatively small so as to fit between the upper and lower sole. It consists of a simple computer processor chip, a small battery and an input and output line. It is connected to the pressure sensor (PS)s and the relay (RL) Switch by wire (WR). The purpose of this structure is to process the loads detected by the pressure sensor (PS)s, then calculate the timing of the catch and release and finally send signals accordingly to the relay (RL).

The protocol for timing the energy hold and release for accelerating or constant-speed running and decelerating or stopping is as follows:

The microprocessor (MP) first determines whether the user is accelerating/maintaining running speed or decelerating/stopping. During accelerating/constant-speed running, heel-strike loads and time duration are fairly consistent with less than 10 percent variation. During decelerating or stopping, however, the heel-strike loads and time duration exceed the prior heel-strike loads and duration by more than 10 percent. Using this program logic and pressure sensor (PS)s, the microprocessor (MP) recognizes the user's mode and responds accordingly. If the user is decelerating or stopping, the microprocessor (MP) does not activate the HRS. If the user is accelerating or maintaining running speed, however, the microprocessor (MP) does activate the HRS by sending a signal to the relay (RL). This triggers the solenoid (SN) to move the arm and lever (LV) which in turn allows the ratchet wheel (RW) to wind until the sole has reached maximum compression in that step. At this point, these components working together hold compression of the sole until the microprocessor (MP) activates the release. The microprocessor (MP) signals the release when the heel pressure sensor (PS) detects that the load is diminishing (or zero) and the ball pressure sensor (PS) detects that the load is in excess of the user's body weight but has begun to diminish. In this way, the user will have a smooth release of stored energy during running only. As a safety precaution, the default for the HRS is disengagement. This insures that if there is a mechanical failure, sole compression will not be held at any time. Therefore, the user's forward energy will be safely converted to vertical energy, allowing the user to safely slow his forward momentum.

The relay (RL) is a small part that can be less than 0.5 cubic inches. It is attached to the underside of the upper mid/heel-sole (D) and is connected to the microprocessor (MP), solenoid (SN) and battery pack (BP), via wire (WR). Its purpose is to receive signals from the microprocessor (MP) and either open or close the electric current from the battery pack (BP).

The battery pack (BP) is a part whose dimensions are unknown. It will depend on the power needed to activate the solenoid (SN), the efficiency of the lever (LV), and the friction between the lever (LV) and the ratchet wheel (RW). If this component can be less than 2 inches by 1 inch by 0.5 inch, then it can be attached to the underside of the upper mid/heel-sole (D). Otherwise it can be attached to the user's shin or belt. The cover is constructed of a material light and non-conductive (e.g. plastic). It is connected to the relay (RL), via wire (WR). The purpose of the battery pack (BP) is to power the solenoid (SN), relay (RL), microprocessor (MP), and pressure sensor (PS).

The solenoid (SN) is a part with dimensions roughly 1 inch cube or less. It is composed of metal components. It is attached to the underside of the upper mid/heel-sole (D). This part is attached to the relay (RL) via wire (WR). It is attached to the lever (LV), via arm. Its purpose is to pull and release the arm and therefore lever (LV).

The arm (AR) is a part approximately 0.25 inches wide and 2 inches long. It is made of light and rigid material (e.g. steel). It is integral to the solenoid (SN) and is attached to the lever (LV). Its purpose is to connect the solenoid (SN) to the lever (LV).

The lever (LV) is a part approximately 1.8 by 0.8 by 0.125 inches and is made of a strong and rigid material (e.g. steel or carbon fiber). It is shaped like a right triangle with two holes at the end of the longer leg and one hole at the end of the shorter leg. The hole at the end of the shorter leg is the mounting point for a pivot axle. The other hole is for mounting the arm and the coil spring (CS). At the right angle is a tooth that fits into the ratchet wheel (RW). Although this part is lubricated for free movement, the coil spring (CS) pulls the lever (LV) away from the solenoid (SN) and the ratchet wheel (RW) where it bumps against a bumper (BR). The bumper (BR) is a steel protrusion from the underside of the upper mid/heel-sole (D). It is covered with rubber for quite and smooth operation. The purpose of the lever (LV) is to convert the solenoid (SN)/arm sliding movement into a catch for the ratchet wheel (RW). The purpose of the coil spring (CS) and bumper (BR) is to keep the lever (LV) from catching the ratchet wheel (RW) until it is activated by the solenoid (SN).

The ratchet wheel (RW) is a circular structure approximately 1 inch in diameter and 0.25 inches thick. It has a 0.25 inch diameter hole in the center and teeth protruding from the lower edge approximately 0.125 in thickness. It has a channel in the underside wherein a clock spring is located. This allows the ratchet wheel (RW) to be self-winding. It is made of a high-strength material (preferably stainless steel). It is attached to the underside of the upper mid/heel-sole (D) by a steel axle. Two winding cable (WC)s are firmly attached to the toothless circumference. Its purpose is to wind the winding cable (WC)s and work in conjunction with the lever (LV) to hold and release the compressed sole. An alternative to this structure could be a spring loaded pin that is connected to the coupled connecting rods.

The winding cables (WC) are structures made of very strong material (e.g. braided steel wire (WR) or synthetic microfilament). One winding cable (WC) is connected to the center front edge of the lower mid-sole (F) and threads through the center front edge of the upper mid/heel-sole (D). The other winding cable (WC) is connected to the center back edge of the lower mid-sole (F) and threads in a perpendicular direction to the center of the upper mid/heel-sole (D). Both winding cable (WC)s are attached to the ratchet wheel (RW). The purpose of these components is to hold the compression of the sole.

Embodiment 5 is a lower cost all sports cross-trainer. In embodiment 5, the lower mid-sole (F) is similar to that of embodiment 1, but has an inflexible section consisting of a lower mid ladder frame (LMLF) (e.g. steel, aluminum) attached to the topside of a lower sole flexible section (Q). The lower mid-sole (F) of embodiment 6 also provides for a lower mid ladder frame (LMLF).

The flexible section of lower sole (Q) is also provided in embodiments 5 and 6 where in the lower soles (E), (F) and (G) are designed not to pivot laterally, relative to the upper mid/heel sole (D). In embodiment 5 and 6 the lower sole flexible section (Q) is a separate structure attached to the underside of the lower ladder frames (LTLF) and (LMLF). In either of these embodiments, it is a moderately flexible yet durable material (e.g. fiberglass, carbon fiber) and its purpose is to allow a user some lateral and rolling movement with their feet in these embodiments that do not otherwise allow lateral pivoting of the lower soles (E), (F) and (G) relative to the upper mid/heel sole (D).

Embodiment 6 is a lightweight high performance all sports cross-trainer. The lower toe sole portion (E) is formed in the same manner as that of embodiment 5.

In embodiment 6, lateral links (A1) and (C1) are also engaged to the topside of the lower mid-sole (F). The purpose of this structure is to: 1) provide traction to the user during mid-stride, and 2) enhance balance and stability during mid-stride in a straight-line run and 3) to help prevent ankle sprains.

The upper sole (1) includes a flex point (P) connecting an upper toe sole (J) to an upper mid/heel portion (D). In embodiment 6, the upper mid/heel sole (D) contains a rectangular cross-sectioned tube extending from its topside perimeter and is hinged to the trailing edge of the upper toe-sole (J) and is integral to the leather shoe upper to form flex point (P) between toe-sole (J). A steel band (SB), which extends across the width of the upper mid/heel and toe soles (J) and (D), is fixed by rivets (R) to the topside leading edge of the upper mid/heel sole (D), and is slidably engaged to the upper toe-sole. The upper mid/heel sole's (D) thickness is relatively thin and is shaped to conform to the profile of the foot. It should be resistant to lateral and longitudinal bending and twisting, compression and expansion and can be constructed with a stiffening brace to achieve this. It should be constructed of a light and inflexible material (e.g. steel, carbon fiber). The purpose of this structure is to: 1) Support the ball, arch and heel of the foot, 2) Provide an anchor point for the tandem hinges/links (A), (A1), (C) and (C1).

Embodiments 1 through 6 are distinguished by different compression depths and different combinations of options. Embodiment 1 has a relatively short compression depth. Embodiments 1, 2 and 5 employ a lower mid-sole (F) that remains parallel to the upper sole. Embodiments 3 and 4 employ a laterally pivoting lower mid-sole (F). The springs on embodiments 1, 2, 3, 5 and 6 store forces less than or somewhat similar to the user's bodyweight. Embodiment 4 uses pressure sensor (PS)s, microprocessor (MP)s, lever (LV)s, ratchet wheel (RW)s and solenoid (SN)s to store and release multiples of the user's bodyweight.

ADDITIONAL DESCRIPTION OF THE ELEMENTS SHOWN IN EMBODIMENTS 1-6

Stopper (L)

Stopper (L) is found on all embodiments in one form or another. In all cases it is a rubber cylinder. As with all rubber, it is more resistant to deformation as it becomes more compressed. Additionally, it is extremely resilient. The stopper (L) is always found attached to the underside of the upper mid/heel sole (D). When the upper mid/heel-sole (D) is compressed together with the lower mid-sole (F), the stopper (L) is engaged with either the primary tandem hinges (A) or the lower mid-sole (F). The purpose of this structure is to: 1) Soften the impact of the foot as limit is reached and 2) Limit the maximum compression of the upper mid/heel sole with the lower mid-sole (F), thus preventing deflection of and/or variance between the primary tandem hinges/links (A) and the upper and lower mid-sole (F)s (for embodiment 1 only).

Cable (M)

The Cable (M) is found on all embodiments except embodiment 1. This structure is a high strength thread or string (e.g. braided steel, carbon fiber, synthetic microfilament). It is attached to the underside of the upper mid/heel sole and the topside of the lower mid-sole (F) or thereabouts. Its purpose is to limit the maximum distance between the upper mid/heel sole and the lower mid-sole (F).

Tread (K)

For all embodiments, the tread (K) is attached to the underside of the lower toe/mid/heel sole (E), (F) and (G). It is constructed of a relatively thin resilient material (e.g. rubber). The purpose of this structure is to provide traction to the user during walking and running on hard surfaces.

Opposing Leaf Springs (CF)

The opposing leaf springs (CF), as shown in embodiment 1—FIG. 1, and embodiments 5 and 6, is an alternative to the torsion spring (S) and may be preferred for use with any other embodiment if it can be shown to be lighter and more durable. It is constructed of carbon fiber of varying width and thickness. The shape of this structure is symmetrical with opposing concave curves, tapering towards the ends and joined at the ends with a flexible polymer. This shape is designed to allow significant compression of the spring without over-stressing any section. The purpose of this structure is to efficiently store and release energy spent during walking and running in a light and compact package so as to return maximum impact absorption.

Independent Torsion Spring Hinge (W)

Independent torsion spring hinge (W) is illustrated on embodiment 2 but could be used in conjunction with the other springs on any other embodiment. It is very similar in design to the primary tandem hinges (A) but stands independent of the other structures in the sole. Its purpose is to house torsion spring (S)s so as to supplement and or reshape the spring forces.

Tension Spring/Rubber Band (V)

The tension spring/rubber band (V) is either a coil tension spring made of spring wire or a rubber band made of elastic material that spans the distance between the hinge joints of the two opposing hinges. The thickness of this structure is dependent upon the forces that it will store which is dependent upon the application and weight and strength of the user. The purpose of this structure is to store energy and release it at an accelerating rate.

Torsion Spring (S)

The torsion spring (S) is a spring constructed of spring steel. It is integrated into the primary tandem hinges (A) or the independent torsion spring hinge (W) (W) (embodiment 2) and may be pre-loaded. The arm length coincides with the length of the hinge's (A) or (W) arms of which it is housed. The number of torsion spring (S)s (S) per shoe and the thickness of the wire (WR) used are based upon the user's weight or leg-strength, depending on the embodiment. Therefore, each shoe should be tailored to the user's weight or leg-strength in addition to their foot size. The purpose of this structure is to efficiently store and release energy spent during walking and running in a compact package so as to return either maximum impact absorption or energy return or the preferred combination of both depending upon the user's application.

Upper Toe Sole (J)

For all embodiments, the upper toe-sole (J) includes a rectangular cross-section tube attached around the perimeter of the topside and is hinged to the rectangular cross section perimeter tubing of the upper mid/heel-sole (D) and is integral to the leather shoe upper. Engaged to the upper toe-sole's (J) underside are secondary tandem hinges (H). Engaged slidably to the topside of the upper toe-sole (J) is a steel band (SB). The upper toe-sole (J) should be constructed of inflexible material (e.g. steel or aluminum). The steel band (SB) should be constructed of relatively thin metal such that it can bend with the upper toe-sole (J) upon step-off. The purpose of this structure is to: 1) support the balls and toes of the foot, 2) allow natural bend of the toes during stride and 3) provide an anchor point for the secondary tandem hinge (H)s Side Wall (OO)

The side wall (OO), used in place of screen (O), is a flexible airtight, water-tight membrane (e.g. rubber) attached to the bottom edge of the upper sole and the top edge of the lower sole most likely on embodiment 1. The purpose of this structure is to: 1) Create a compressible air-filled cavity and 2) Protect the inside structures of the shoe from water and dirt/debris.

Inlet Valve (IV)

The inlet valve (IV) is a simple valve that consists of a rubber slit and a rubber membrane attached on one side. These two structures are located on the rearward section of the side wall (OO) positioned on the right and left of the user's heel, closer to the upper sole than the lower sole. The purpose of these structures is to allow air to flow into the sole cavity during expansion of the lower sole but not out during compression of the lower sole.

Outlet Valve (OV)

The outlet valve (OV) is a simple valve that consists of a rubber slit and a rubber membrane attached on one side. Four of these seven structures are located in the fore section of the upper toe-sole (J) and three in the middle section of the upper mid/heel-sole (D). The purpose of these structures is to allow air to flow from the sole onto the user's foot during compression of the lower sole but not into the sole cavity during its expansion.

Pivots (N)

Pivots (N) are used in several areas on several embodiments. They are varying diameters and lengths depending on the application and the load. They are made of high strength material (e.g. steel). Their purpose is to allow controlled, low-friction movement of the lower sole.

Rivet (R)

Rivets (R) are used in several areas on several embodiments. They are varying diameters and lengths and can be steel or aluminum depending on the load. Their purpose is to attach two structures permanently and inexpensively.

Screen (O)

The screen (O) is a relatively thin fabric of varying height depending on the embodiment. It is flexible and stretchable but is resistant to tearing. It may be airtight and water-tight but this is not a necessity. It is an effective barrier to dirt and debris. It is attached to the lower edge circumference of the upper toe/mid/heel-sole and the upper edge circumference of the lower toe/mid/heel-sole. Its purpose is to: 1) Protect the sole structures from dirt and debris and 2) Hide the inner workings of the shoe for improved appearance and possibly, 3) to protect the sole structures from moisture.

Flex Point (P)

The flex point (P) is a line where a particular structure is designed to flex.

The invention claimed is:

1. A shoe suspension system adapted for use with a shoe or boot comprising:

an upper sole engaged to a bottom of the shoe or boot having an upper toe sole and an upper heel sole, the upper toe sole being pivotally engaged to the upper heel sole;

a lower sole having a lower toe sole and a lower heel sole, the lower toe sole pivotally engaged to the lower heel sole;

at least one secondary tandem hinge pivotally engaged between the upper toe sole and the lower toe sole, the secondary tandem hinge adapted to open and close, maintaining a parallel relationship between the upper toe sole and the lower toe sole;

a plurality of primary tandem hinges pivotally engaged between the upper heel sole and the lower heel sole, the plurality of primary tandem hinges adapted to open and close whereas the upper heel sole is held in horizontal synchronization and parallel to the lower heel sole by means of at least one telescoping horizontal guide tube and telescoping horizontal guide rod; and at least one return spring engaged between the upper sole and the lower sole.

2. A shoe suspension system adapted for use with a shoe, the shoe suspension system comprising:

an upper sole engaged to a bottom of the shoe having an upper toe sole and an upper heel sole, the upper toe sole pivotally engaged to the upper heel sole;

a lower sole having a lower toe sole pivotally engaged to a lower heel sole;

at least one secondary tandem hinge engaged between the upper toe sole and the lower toe sole, the secondary tandem hinge adapted to open and close such that the upper toe sole remains parallel and maintains lateral synchronization with respect to the lower toe sole;

a plurality of primary tandem hinges engaged between the upper heel sole and the lower heel sole, the plurality of primary tandem hinges adapted to open and close such that the upper heel sole remains parallel and maintains both horizontal synchronization and lateral synchronization with the lower heel sole by means of at least one telescoping horizontal guide tube and telescoping horizontal guide rod; and at least one return spring engaged between the upper sole and the lower sole.

3. The shoe suspension system adapted for use with a shoe according to claim 2, wherein the primary tandem hinge comprises:

a plurality of hinge pins;

at least two primary hinges pivotally attached at one end to the upper heel sole, the at least two primary hinges pivotally attached at a distal end to the lower heel sole and each of the at least two primary hinges having one of the hinge pins;

at least one primary opposing hinge pivotally attached at a first end to the upper heel sole, the at least one primary opposing hinge pivotally attached at a distal end to the lower heel sole and each of the at least one primary opposing hinges having one of the hinge pins;

a primary connecting rod linking each hinge pin of each of the at least two primary hinges;

an opposing connecting rod linking the hinge pins of the at least one primary opposing hinge, the opposing connecting rod slideably engaged with the primary connecting rod, thereby keeping the hinge pins in a common plane; and at least one spring urging the lower heel sole away from the upper heel sole.

4. The shoe suspension system adapted for use with a shoe according to claim 2, wherein at least one of the plurality of primary tandem hinges is configured at right angle to another of the plurality of primary tandem hinges.

5. A shoe suspension system adapted for use with a shoe, the shoe suspension system comprising:

an upper sole engaged to a bottom of the shoe;

a lower sole;

a plurality of hinge pins;

at least two primary hinges pivotally attached at one end to the upper sole, the at least two primary hinges pivotally attached at a distal end to the lower sole and each of the at least two primary hinges adapted to open and close in a first direction by means of one of the hinge pins;

at least one primary opposing hinge pivotally attached at a first end to the upper sole, the at least one primary opposing hinge pivotally attached at a distal end to the lower sole and each of the at least one primary opposing hinge adapted to open and close in an opposing direction by means of another one of the hinge pins;

a primary connecting rod linking each hinge pin of each of the at least two primary hinges;

a primary opposing connecting rod linking the at least one hinge pin of the primary opposing hinges to the primary opposing connecting rod, the primary opposing connecting rod slideably engaged with the primary connecting rod, thereby keeping the hinge pins in a common plane; and at least one return spring engaged between the upper sole and the lower sole.

* * * * *